US005294194A

United States Patent [19]

Lombardo

[11] Patent Number: 5,294,194

[45] Date of Patent: Mar. 15, 1994

[54] CATCH CONTAINER

[76] Inventor: Thomas Lombardo, 35 Burnside Ave., Staten Island, N.Y. 10302

[21] Appl. No.: 890,763

[22] Filed: Jun. 1, 1992

[51] Int. Cl.[5] ..... A47B 97/00

[52] U.S. Cl. ..... 312/229; 312/293.1; 312/308; 220/482

[58] Field of Search ..... 312/243.1, 229, 308, 312/321.5; 211/88, 126; 220/480, 482; 224/42.46 R; 248/214

[56] References Cited

U.S. PATENT DOCUMENTS

| | | | |
|---|---|---|---|
| 444,531 | 1/1891 | Greene | 312/308 |
| 1,056,702 | 3/1913 | Ludtke | 312/308 |
| 1,072,022 | 9/1913 | Miller | 248/214 |
| 1,838,558 | 12/1931 | Kolodny | 312/308 |
| 1,888,127 | 11/1932 | Heardne | 220/482 |
| 2,534,793 | 12/1950 | Olson | 220/480 |
| 3,325,038 | 6/1967 | Ferney | 220/482 |
| 3,386,444 | 6/1968 | Brenner | 5/601 |
| 3,586,276 | 6/1971 | O'Mahoney | 248/215 |
| 3,904,041 | 9/1975 | Medgebow | 248/215 |
| 4,155,310 | 5/1979 | Gregory | 108/26 |
| 4,756,582 | 7/1988 | Heien | 312/229 |
| 4,802,595 | 2/1989 | Northington | 108/26 |
| 4,974,803 | 12/1990 | Richer et al. | 248/214 |

*Primary Examiner*—Flemming Saether
*Attorney, Agent, or Firm*—Eric A. LaMorte

[57] ABSTRACT

The present invention is a catch container for retaining debris or other materials wiped from the edge of a work surface. The present invention catch container includes a receptacle structure, a mounting bracket adjustably attached to the receptacle structure, and a sloped surface descending toward the receptacle from the mounting bracket. The present invention catch container is mounted under a work surface so that debris displaced from the work surface lands upon the sloped surface. The sloped surface then guides the debris into the receptacle without slashing or spillage.

13 Claims, 5 Drawing Sheets

CATCH CONTAINER

BACKGROUND OF THE INVENTION

1. Field of the Invention

The present invention relates to a container mountable on the side of a work table or counter top to provide a catch basin for debris. More particularly, the present invention relates to catch container devices that include a sloped face that descends into the container, wherein the entire catch container device is mountable to the face of a drawer below a work surface such that debris on the work table can be readily wiped off the edge of the work surface and into the container without spillage.

2. Background of the Invention

When food is prepared on a work surface such as a table or kitchen counter top, there inevitably remains debris in the form of small bits of food, packaging, inedible portions of the food, etc., that remains on the work surface after the food is prepared. The debris is often wet and comprised of numerous small pieces that tend to stick to the work surface. Consequently, the debris is not effectively picked up by hand. Rather, the food debris is commonly wiped off the work surface with a rag, sponge or the like.

Typically, in a kitchen, food is prepared on the work surface of the kitchen counter top. When the food preparation is finished, the waste and other debris is often wiped into the sink (if a garbage disposal is available) or wiped off the edge of the counter top into the hand of the person cleaning or directly into a trash receptacle. As will be recognized by people who clean work surfaces in such a manner, there exist certain disadvantages that complicate this typical cleaning procedure.

The waste and debris associated with food preparation is often wet. Additionally, it may also include fluids such as gravy, blood, sauce, etc. that give the debris a significant fluid volume. When such debris is wiped off a counter top and into a trash receptacle, the fluid tends to cohere to the side surfaces of the counter top, resulting in the fluid dripping off the counter top onto the floor in areas not corresponding to the position of the trash receptacle. Similar unsatisfactory results are obtained when the wet debris is wiped into a cupped hand. A person's hand can only contain a limited volume of fluid and often leaks. As such, the traditional use of just a cupped hand also results in the debris dripping down the face of the kitchen cabinet or dripping directly onto the floor. Yet another disadvantage of using a cupped hand to remove debris wiped from a counter top, is that the debris may be offensive to the individual cleaning the work surface. For example, the debris may contain blood, entrails, animal fat or grease which requires the person cleaning the debris to thoroughly wash his or her hands after contacting the debris.

As will be later thoroughly described the present invention is a shaped catch container that mounts to the face of a cabinet drawer below the edge of a kitchen counter top. The prior art is replete with container devices designed to be mounted at various locations and in the prior art there exist container patents that can be adapted to be mounted to vertical planar surfaces such as cabinet drawers. These prior art patents are exemplified by the following.

U.S. Pat. No. 1,072,022 to Miller, entitled GARBAGE CAN, and issued Sep. 2, 1913 shows a container supportable against a vertical planar surface by two J-shaped brackets. Additionally, the bottom surface of the receptacle is sloped, directing any contained debris to a hinged door. The Miller patent is not adjustable in its mountings and does not contain a receptacle structure capable of retaining fluid.

U.S. Pat. No. 3,904,041 to Medgebow, entitled COMMERCIAL KITCHEN RACK STRUCTURE and issued Sep. 9, 1975 shows a container structure mountable to the edge rail of a kitchen table via two J-shaped brackets. The container includes multiple flange receptacles for holding kitchen accessories and is not formed to effectively retain debris.

U.S. Pat. No. 4,974,803 to Richer et al, entitled RECEPTACLE HOLDER and issued Dec. 4, 1990 shows a device for supporting various other containers off the edge of a veranda. The Richer patent includes a continuous J-shaped bracket but does not disclose a bracket adjustment means or other features that would suggest its use with a kitchen counter top.

U.S. Pat. No. 3,586,276 to O'Mahoney entitled SUPPORT STRUCTURE AND BASKET, and issued Jun. 22, 1971 shows a container mountable onto a tabular frame. The O'Mahoney patent shows a J-shaped bracket supporting a container but does not disclose the features needed to hold fluid and debris wiped from a kitchen counter top without spillage.

Kitchens vary from residence to residence and very few kitchens are identical. As such it is a primary objective of the present invention to provide a container that can be selectively mounted below the edge of a kitchen counter in most every type and style of kitchen, and to provide a means associated with the present invention container to prevent fluids from cohering to the sides of the kitchen counter top and dripping down the face of the kitchen counter when waste and debris are wiped off the counter top into the container.

BRIEF DESCRIPTION OF THE DRAWINGS

For a better understanding of the present invention, reference is made to the following description of exemplary embodiments thereof, considered in conjunction with the accompanying drawings, in which.

SUMMARY OF THE INVENTION

The present invention relates to a catch container for use when clearing debris for the top of the work surface. The catch container includes a receptacle capable of retaining a volume of liquid and debris without leakage. Attached to the receptacle is a mounting means for attaching the receptacle to a side surface below an edge of the work surface. Positioned atop the mounting means is a sloped surface the has an angle of inclination descending toward the receptacle. As debris and fluid is wiped off the edge of the work surface, the debris and fluid lands upon the sloped surface of the present invention catch container. The descending angle of inclination of the sloped surface channels the fluid and debris into the receptacle, thereby allowing the debris and fluid to fill the catch container without the splashing or spillage of its contents.

The present invention catch container may also include an adjustment means for selectively adjusting the distance in between the mounting means and the receptacle. By utilizing an adjustable mounting means, the present invention can be adapted for use with most work surfaces regardless to the structure below the work surface on which the present invention catch container is mounted.

DETAILED DESCRIPTION OF THE INVENTION

Although the present invention catch container can be used in many applications where debris is wiped from a work surface, such as a carpenter's bench, machine table or the like, the present invention container is especially suitable for use in connection with the removal of debris from kitchen counter tops. Accordingly, the present invention will be hereinafter described in connection with such a kitchen application.

Figure 1:
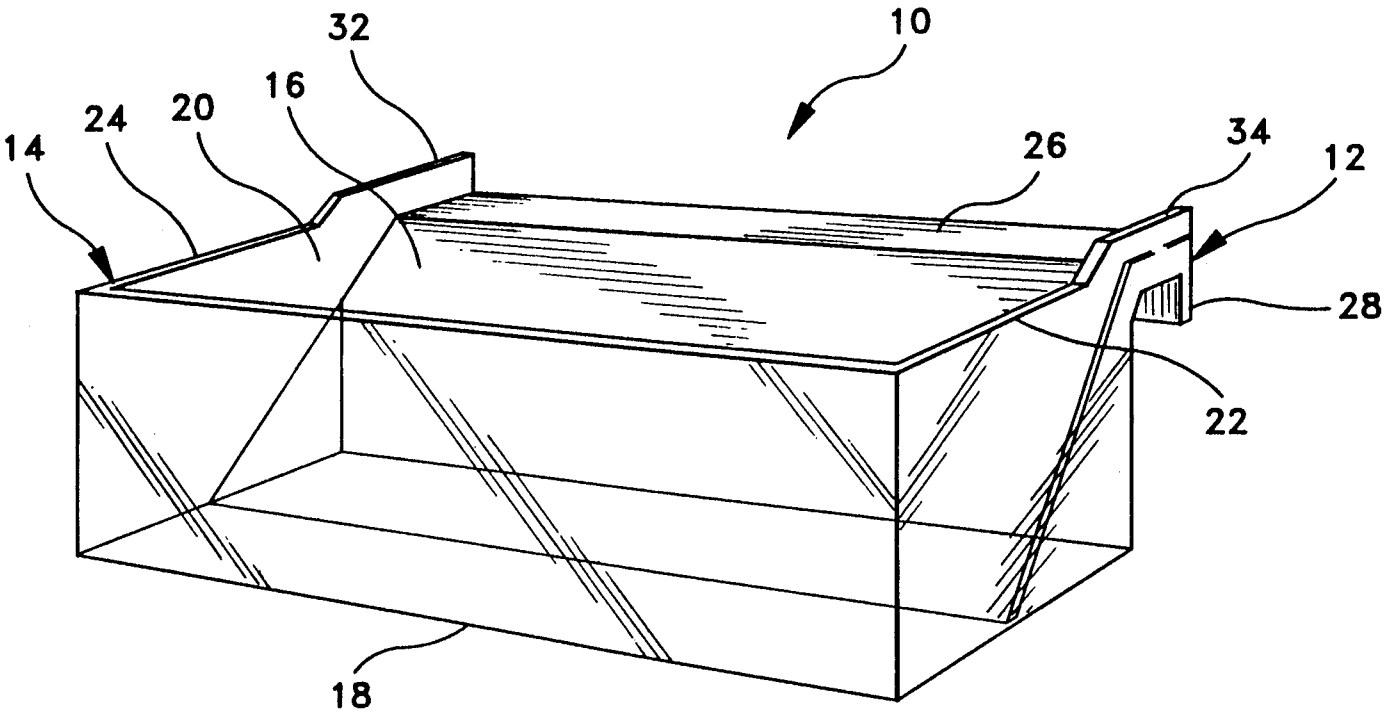
FIG. 1 is a perspective view of one preferred embodiment of the present invention catch container.

Referring to FIG. 1, the present invention catch container 10 is shown having a retaining bracket 12 joined to a fluid impermeable receptacle 14. Positioned within the receptacle 14 is a sloped deflecting wall 16 which extends from the bottom 18 of the receptacle 14 out through the open top 20 of the receptacle 14. The deflecting wall 16 transgresses the length of the receptacle 14, abutting against the first and second side walls 22, 24 of the receptacle 14. The deflecting wall 16 is joined to the first and second side walls 22, 24 in a fluid impervious manner.

Figure 2:
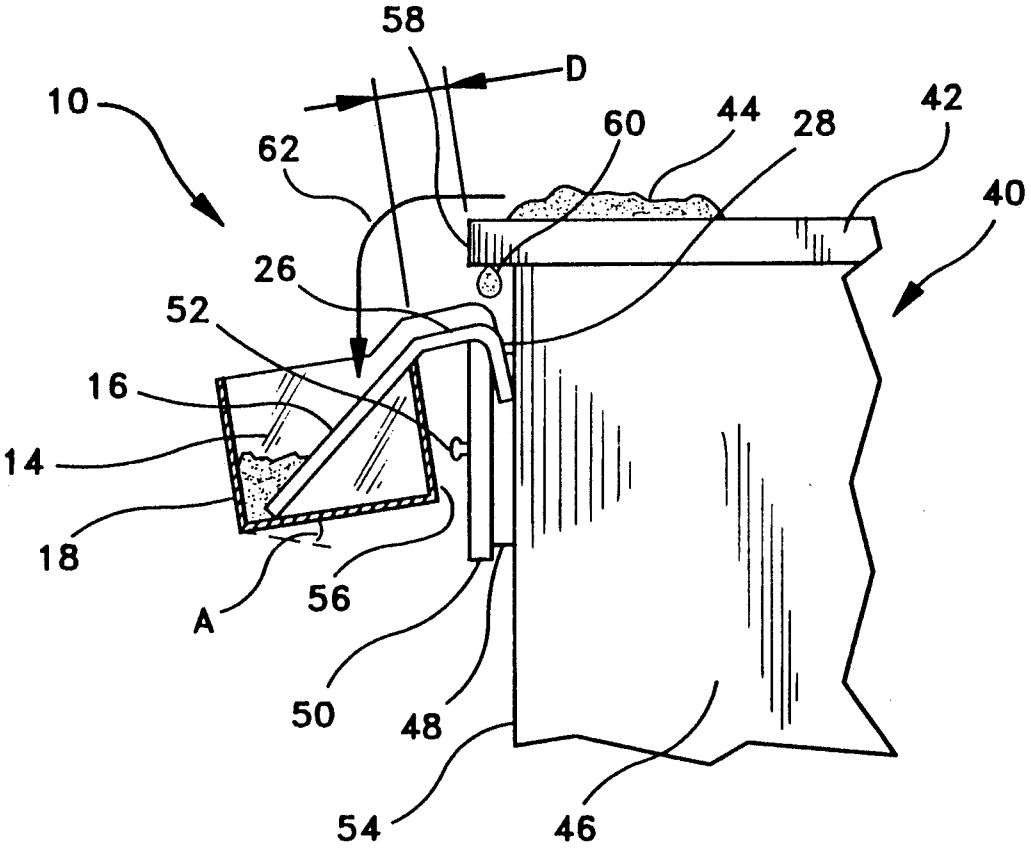
FIG. 2 is a cross sectional view of the preferred embodiment of the present invention catch container shown in FIG. 1, the present invention catch container being shown in conjunction with a typical kitchen cabinet and counter top arrangement to facilitate consideration and discussion.

Referring to FIG. 2 in conjunction with FIG. 1, there can be seen that once above the open top region 20 of the deflecting wall 16, the shape of the deflecting wall 16 changes to form the retaining bracket 12. The retaining bracket 12 is substantially L-shaped having a transition region 26 projecting in the horizontal that terminates at a bracket flange 28, that projects in the vertical. The first side wall 22 and the second side wall 24 contain a first and second projection 32, 34, respectively that extend from the first and second side walls 22, 24, above the open top region 20. The first and second projections 32, 34 contact the edge surfaces of the transition region 26 of the retaining bracket 12, in such a manner so as to form a fluid impervious seal between the first and second projections 32, 34 and the contacted side edges of the transition region 26.

In FIG. 2, there is shown the present invention catch container 10 installed in combination with a typical kitchen cabinet and counter top assembly 40. The kitchen cabinet and counter top assembly 40 includes a counter top 42 upon which work is performed and debris 44 is accumulated. Below the counter top 42 is the cabinet structure 46 containing a cabinet drawer 48. The cabinet drawer 48 typically has a face plate 50 and a handle 52 which facilitate the opening and closing of the cabinet drawer 48 within the cabinet structure 46.

When installing the present invention catch container 10, the cabinet drawer 48 is opened such that the retaining bracket 12 can be hooked on the top of the face plate 50 of the cabinet drawer 48. Once in position, the cabinet drawer 48 is closed so that the bracket flange 28 of the retaining bracket 12 is caught between the face plate 50 of the cabinet drawer 48 and a forward surface 54 of the cabinet structure 46. The bracket flange 28 is positioned a distance D away from the rearward wall 58 of the receptacle 14. The distance D is designed to be longer than the combined widths of the drawer face plate 50 and handle 52. Since the distance D built into the retaining bracket 12 is wider than the combined widths of the face plate 50 and the handle 52, gravity pivots the present invention catch container 10 about the retaining bracket 12, thereby causing the present invention catch container 10 to tilt backward. The backward tilt of the present invention catch container 10 is exemplified in FIG. 2 by the bottom surface 18 of the receptacle 14 being shown inclined by angle A from the horizontal. As such, it should be understood that the over-extension of the retaining bracket 12 has caused the present invention catch container 10 to tilt backward away from the cabinet structure 46 by an angle A.

When debris 44 is wiped toward the forward edge 58 of the counter top 42, cohesion makes the fluid of the debris want to run down the face of the counter top forward edge 58. As fluid flows down the counter top forward edge 58, it accumulates below the counter top 42, where it forms into droplets 60 and drips either directly onto the floor or onto the forward surface 54 of the cabinet structure 46. With the present invention catch container 10 attached to the face plate 50 of the cabinet drawer 48, the transition region 26 of the sloped deflecting wall 16, which forms the horizontal projection of the retaining bracket 12, is now positioned below the overhang region of the counter top 42. The transition region extends below the overhang from a point below the counter top forward edge 58 to a point proximate the forward surface 54 of the cabinet structure 46. With the transition region 26 positioned below the overhang of the counter top 42, any debris that coheres to the counter top forward edge 58 and accumulates below the counter top 42 will drip from, or flow onto, the transition region 26 of the present invention catch container 10.

The present invention catch container 10 is tilted backward away from the face plate 50 of the cabinet drawer 48 by an angle equivalent to angle A. As such, the transition region 26 of the present invention catch container 10, which nominally extends in the horizontal, is inclined out of the horizontal, sloping downward toward the receptacle 14 of the present invention catch container 10. Since the transition region 26 is positioned below the overhang of the counter top 42 and the transition region 26 is sloped toward the receptacle 14, any fluid or debris that drips off the counter top 42 will strike the transition region 26 and be directed into the receptacle 14 by gravity. As has been previously mentioned, the transition region 26 is confined by the side wall projections 32, 34 which extend from the first and second side walls 22, 24, respectively. The side wall projections 32, 34 extend above the plane of the transition region 26, along both edges of the transition region. Consequently, the side wall projections 32,34 act as fluid barriers preventing fluid and debris present on the transition region 26 from flowing over the sides of the transition region 26.

The slope of the transition region 26 causes any fluid or debris that lands upon the transition region 26 to flow onto the sloped deflecting wall 16 within the receptacle 14. In the shown embodiment, the deflecting wall 16 travels the entire depth of the receptacle 14, terminating at the bottom surface 18 of the receptacle 14. However, it should be understood that the deflecting wall 16 need not lead to the bottom 18 of the receptacle 14, rather the deflecting wall 16 may just lead into the receptacle 14. Once the debris or fluid flows onto the sloped deflecting wall 16, the material is guided into the receptacle 14, where it is retained.

The debris 44 that accumulates on the work surface of the counter top 42 does not all adhere to the counter top 42 and drip into the present invention catch container 10 in the manner previously described. Rather, most of the debris 44 wiped from atop the counter top 42 falls directly onto the sloped deflecting wall 16, as indicated by arrow 62. The present invention catch container 10 can be constructed without the deflecting wall 16 that extends into the receptacle 14. However, the presence of a deflective wall 16 that extends well into the receptacle 14, serves a useful function. By having a deflecting wall 16 that extends into the receptacle 14 at an inclined angle, the deflecting wall 16 is assured to extend directly below the forward edge 58 of the counter top 42. Consequently, as debris 44 from atop the counter top 42 is wiped off the edge 58 of the counter top 42, the debris 44 lands upon the deflecting wall 16. Gravity then pulls the debris down the face of the deflecting wall 16 where it accumulates at the bottom of the receptacle 14. If the deflecting wall 16 were not present, or did not extend below the forward edge 58 of the counter top 42, the debris 44 wiped from atop the counter top 42 would fall directly to the bottom surface 18 of the receptacle 14. The debris would therein accumulate on the bottom surface 18 of the receptacle 14 directly under the forward edge 58 of the counter top 42 and directly in the path of new debris that maybe wiped from atop the counter top 42. Consequently, as new debris falls into the receptacle 14, it would strike the old debris causing it to splash and splatter. As such, the debris may fly out of the receptacle 14 and fall to the floor or strike the clothes of the person cleaning the counter top 42.

To prevent debris from splashing, the deflecting wall 16 is positioned in the receptacle 14 below the forward edge 58 of the counter top 42. As such the debris 44 from atop the counter top 42 strikes the deflecting wall 16 where it is gently channeled down the slope of the deflecting wall 16 and into the bottom of the receptacle. The deflecting wall 16 thereby prevents debris from accumulating under the forward edge 58 of the counter top 4 and prevents splashing from occurring.

Figure 3:
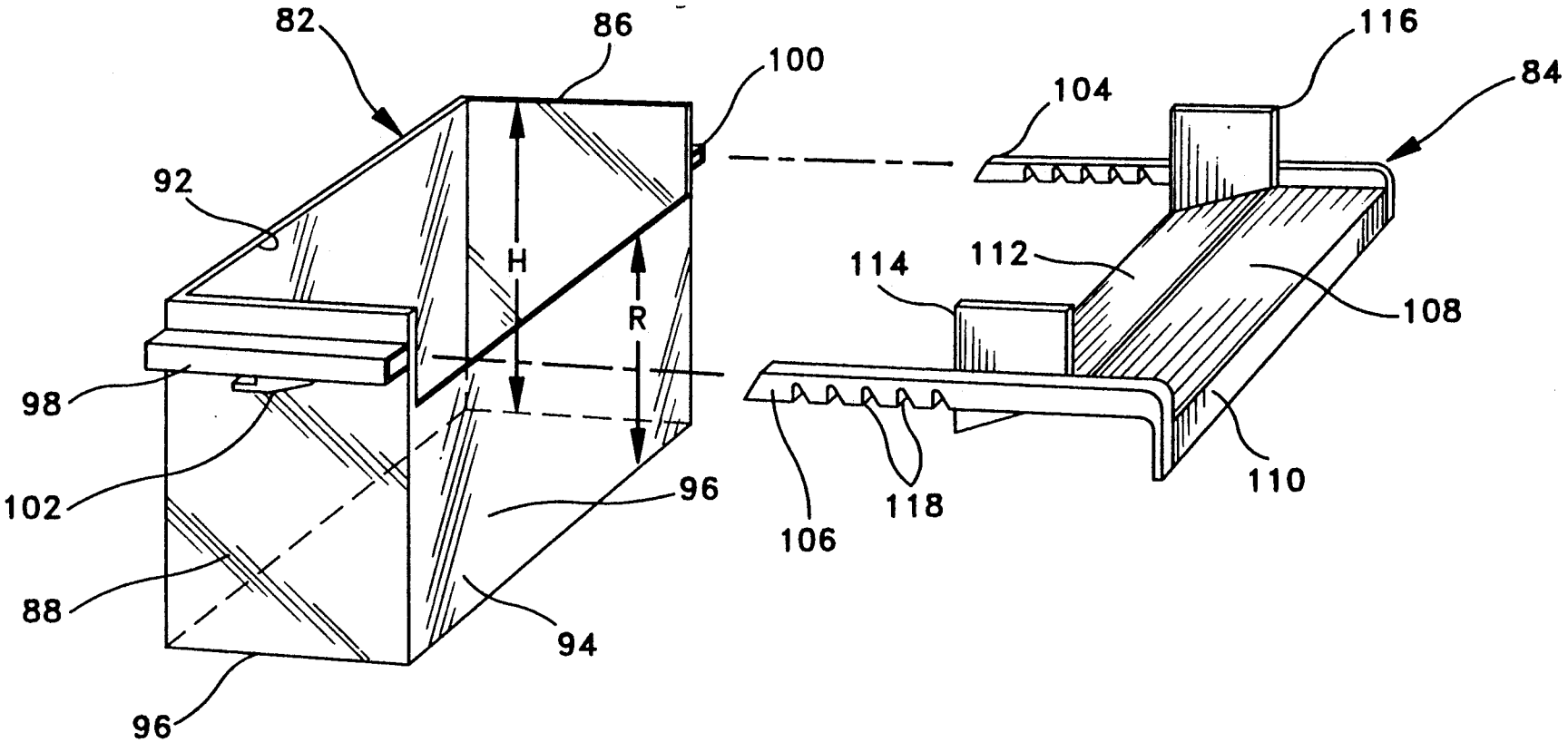
FIG. 3 is a perspective view of an alternative embodiment of the present invention catch container, the present invention catch container being shown in a partially exploded fashion to facilitate discussion.

Referring to FIG. 3, an alternative exemplary embodiment of the present invention catch container 80 is shown. Unlike the previously described embodiment of FIGS. 1 and 2, the embodiment of FIG. 3 is comprised of two separable components, a receptacle 82 and a retaining bracket assembly 84.

The receptacle 82 is formed to be rectangular having a first and second side wall 86, 88, a front wall 92 and a rear wall 94 all depending upwardly in the perpendicular from the peripheral edges of a rectangular bottom plate 96. It should be understood that the rectangular shape of the receptacle 82 is merely exemplary and any other geometry capable of retaining fluid and debris may be used. Referring to the preferred embodiment shown by FIG. 3, it can be seen that the front wall 92 and the first and second side walls 86, 88 all extend the same height H above the bottom plate 96. The rear wall 94, however, does not extend to height H. Rather, the rear wall 94 extends to a reduced height R, thereby being shorter than the three other walls of the receptacle 82.

Extending from the exterior surfaces of both the first and second side walls 86, 88, respectively, are hollow latching devices 98, 100. Each attaching device 98, 100 defining a central lumen through its hollow construction. Formed as part of each latching device 98, 100 is a locking pawl 102. Each locking pawl 102 is elastically deformable and is biased into the lumen of each latching device 98, 100.

The retaining bracket assembly 84 is formed having two primary latch arms 104, 106 extending parallel in the horizontal from both ends of the bracket assembly 84. Suspended between the two latch arms 104, 106 is a horizontal member 108, the horizontal member being substantially planar and extending at a perpendicular from each of the latch arms 104, 106 so as to traverse the space in between each of the latch arms 104, 106. Depending from the horizontal member, opposite receptacle 82, is a vertical member 110. The vertical member 110 also traversing the space in between each of the latch arms 104, 106 so as to form an L-shaped profile when combined with the horizontal member 108. Depending from the edge of the horizontal member 108, opposite the vertical member 110, is a deflecting wall 112. The deflecting wall 112 diverges from the plane of the horizontal member 108 creating an angle of inclination C relative to the plane of the horizontal member 108 and latch arms 104, 106. Since the angle of inclination C of the deflecting wall 112 causes the deflecting wall 112 to extend below the latch arms 104, 106, the ends of the deflecting wall 112 do not terminate at the latch arms 104, 106 as do the ends of the horizontal member 101. Rather, two projections 114, 116 extend upwardly from the ends of the deflecting wall 112. Each of the projections 114, 116 extending in a plane substantially perpendicular to that of the latch arms 104, 106. The projections 114, 116 span the gap between each end of the deflecting wall 112 and each latch arm 104, 106 caused by the diverging angle of inclination C of the deflecting wall 112. Each of the projections 114, 116 also extend to a point above each of the latch arms 104, 106.

Notches 118 are formed on each of the latch arms 104, 106 and each of the latch arms 104, 106 has a profile shape that allows the latch arms 104, 106 to pass into the lumens of two hollow latching devices 98, 100. As the retaining bracket assembly 84 is joined to the receptacle 82, the latch arms 104, 106 pass into the hollow latching devices 98, 100. The latching arms 104, 106 contact the locking pawls 102 within each hollow latching devices 98, 100, thereby elastically deforming each of the locking pawls 102 out of the lumen of each latching device 98, 100. Consequently, a spring bias is formed in each of the deformed locking pawls 102. As the notches 118 in each latch arm 104, 106 pass over the deformed locking pawls 102, the spring bias of the locking pawls 102 cause the locking pawls 102 to engage the notches 118, thereby attaching the retaining bracket assembly 84 to the receptacle 82 in a set position. Since multiple notches 118 are formed in each of the latch arms 104, 106, it should be understood that the retaining bracket assembly 84 can be attached to the receptacle 82 at any one of a number of positions. Each position effecting the distance D1 at which the rear wall 94 of the receptacle 82 and the vertical member 110 of the retaining bracket assembly 84 are separated.

It should be understood that the use of the notches 118 and locking pawls 102 in the embodiment of the present invention catch container 80 is purely exemplary and any other known locking means can be used in place and stead of the pawl and notch system described. For example, the latch arms 104, 106 may have a plurality of apertures formed through it, and the receptacle 82 may have projections that engage the apertures as desired, such as with snap fasteners or threaded fasteners. All such known attachment systems may be adapted to the present invention catch container design.

Figure 4:
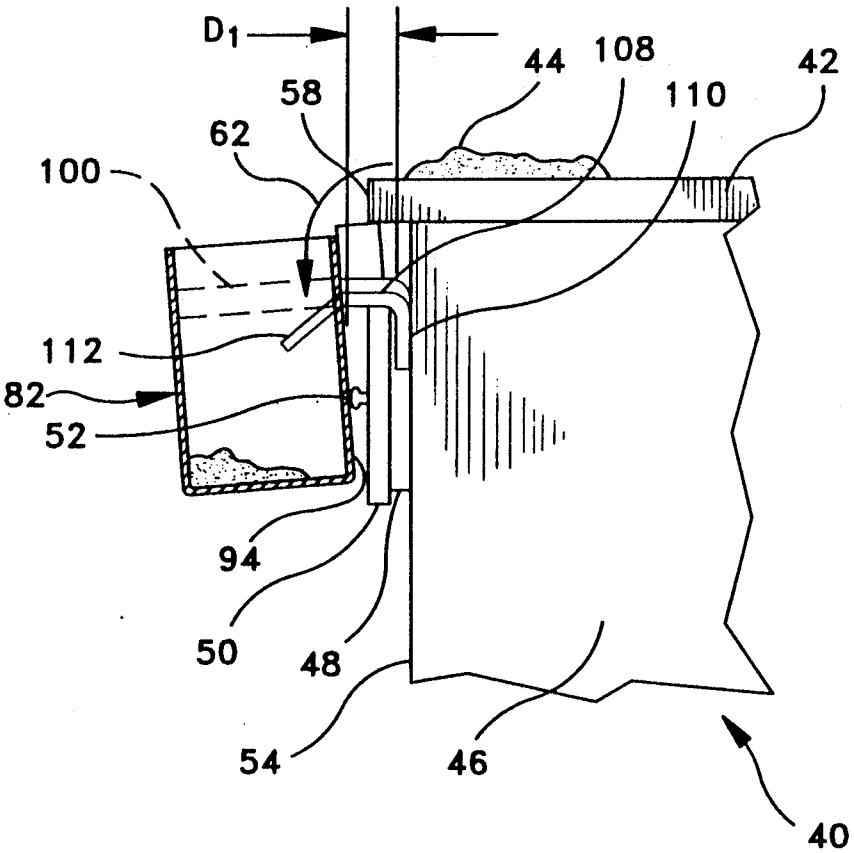
FIG. 4 is a cross sectional view of an alternate preferred embodiment of the present invention catch container of FIG. 3 shown in conjunction with a typical kitchen cabinet and counter top arrangement to help illustrate function.

In FIG. 4, the present invention catch container 80, as described in association with FIG. 3 is shown in combination with a kitchen cabinet and counter top assembly 40 such as the one previously described in regard to FIG. 2. The components of the kitchen cabinet and counter top assembly 40 will therefore have the same reference numerals as were described in FIG. 2. Referring now to FIG. 4 it can be seen that when the present invention catch container 80 is mounted to the drawer 48 within a cabinet structure 46, the deflecting wall 112 of the present invention catch container 80 is positioned below the forward edge 56 of the counter top 42. The deflecting wall 112 extends into the receptacle 82, as such any debris wiped from the counter top 42 that lands upon the deflecting wall 112 will be directed into the receptacle 82 in the manner previously described with regard to the embodiment of FIGS. 1 and 2. However, the primary difference with the embodiment of the present invention catch container 80 shown in FIGS. 3 and 4 is that the retaining bracket assembly 84 is adjustably positionable relative to the receptacle 82. As such, the distance D1 in between the receptacle 14 and the vertical member 110 of the retaining bracket assembly 84 can be selectively altered.

The rear wall 94 of receptacle 82 has a reduced height R as compared to the other three walls of the receptacle 82. The reduction of height allows the retaining bracket assembly 84 to be adjusted in position without the deflecting wall 112 interfering with the rear wall 94. It will be recognized that all drawers 48 from different cabinet structures 46 vary widely in construction and design. One of the most common points of variations in drawers 48 that effects the performance of the present invention catch container 80, is the thickness of the drawer face plate 50 and the type of handle 52 used on the drawer 48. The thickness of the drawer face plate 50 and the size of the handle 52 combine to determine the width that the retaining bracket assembly 84 must span in order to properly be mounted on the receptacle 82. As has been previously explained, it is desirable to have the retaining bracket assembly 84 overextend the combined widths of the drawer face plate 50 and the handle 52 so that the receptacle pivots about the retaining bracket assembly 84 and tilts backward away from the drawer face plate 50. By providing an adjustable attachment means between the retaining bracket assembly 84 and the receptacle 82, the present invention catch container 80 can be adjusted to properly mount on a wide variety of cabinet structures regardless of the handle or face plates present on the drawers.

In the first described embodiment of FIGS. 1 and 2, fluid and debris were prevented from flowing off the sides of the deflecting wall by the presence of the side walls of the receptacle. In the embodiment of the present invention shown in FIGS. 3 and 4, the position of the deflecting wall 112 is variable relative to the position of the receptacle 82. As such, projections 114, 116 have been formed on the side edges of the deflecting wall 112. The projections 114, 116 prevent fluid and debris from flowing off the sides of the deflecting wall 112. The extension of the projections 114, 116 above the latch arms 98, 100 further acts as splash guards preventing debris from splashing out from the sides of the present invention catch container 80.

Figure 5:
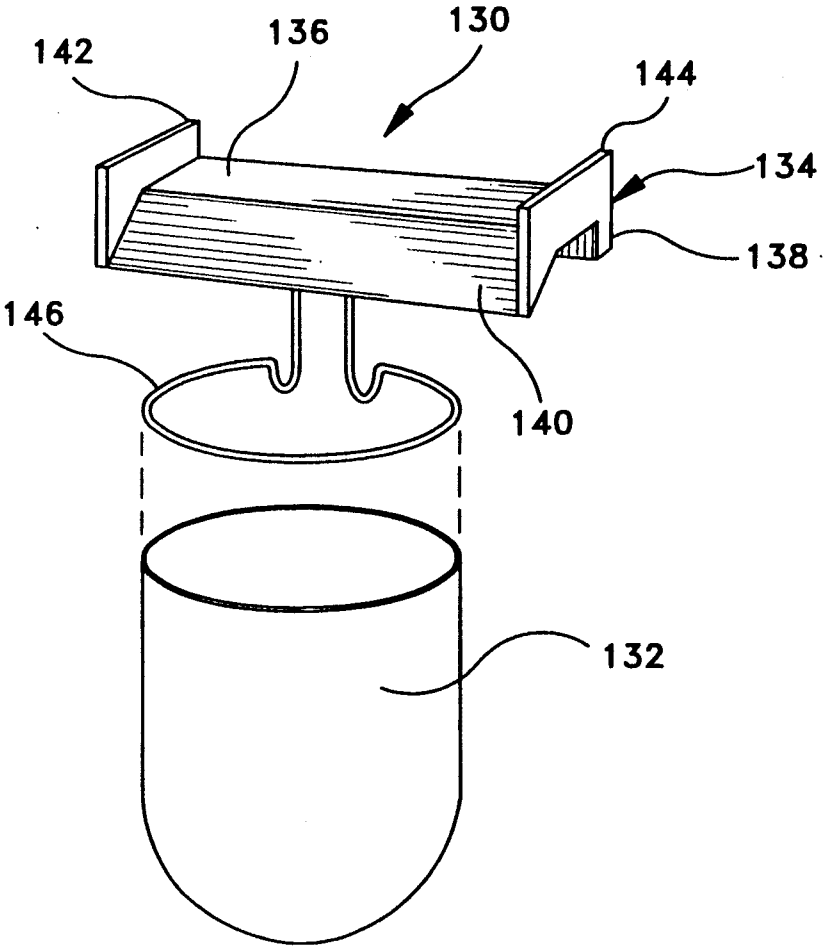
FIG. 5 is a perspective view of a second alternative embodiment of the present invention container, shown in an exploded fashion in conjunction with a plastic bag.

Referring to FIG. 5, a third preferred embodiment of the present invention catch container 130 is shown wherein the receptacle is formed of a plastic bag 132 such as those commercially available for trash receptacles. The retaining bracket assembly 134 is specifically designed to retain the plastic bag 132 in an open position and guide debris and other wastes into the plastic bag 132. As with previous embodiments, the retaining bracket assembly 134 includes a horizontal member 136 traversing the length of the bracket assembly 134. Depending from the horizontal member 136 opposite the direction of the plastic bag 132 is a vertically extending flange 138. Extending from the horizontal member 136, opposite the vertical flange 138 is a deflecting wall 140. Vertical projections 142, 144 are formed on either side of the deflecting wall 140, thereby defining a channel wherein the deflecting wall 140 is the bottom surface.

Extending from the deflecting wall 140 is at least one wire member 146, wherein the wire member 146 defines the periphery of a shape into which the open plastic bag 132 will be held. The wire member 146 is shaped so that the open edge of the plastic bag 132 can be folded over the wire member 146, thereby retaining the plastic bag 132 on the wire member 146.

Figure 6:
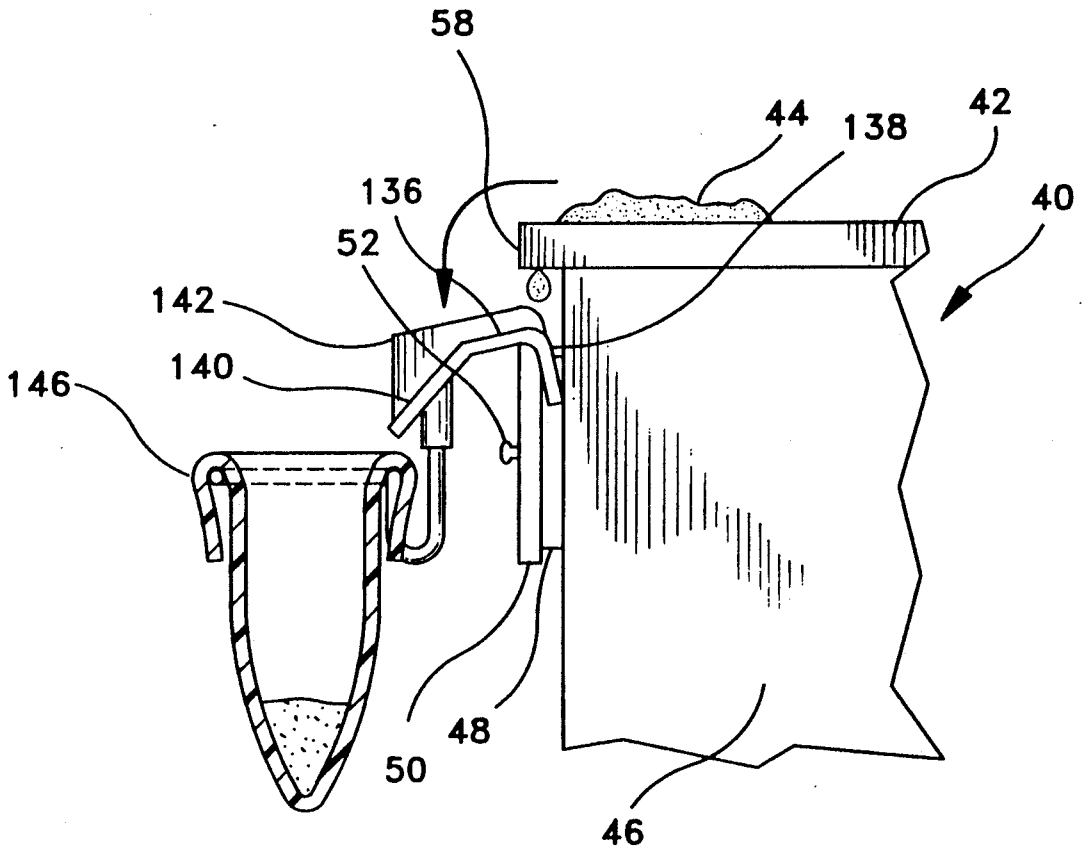
FIG. 6 is a cross sectional view of the preferred embodiment of the present invention catch container shown in FIG. 5, the present invention catch container being shown in conjunction with a typical kitchen cabinet and counter top arrangement for the purposes of discussion.

In FIG. 6, the present invention catch container 130, as described in association with FIG. 5, is shown in combination with a kitchen cabinet and counter top assembly 40 such as the one previously described with regard to FIGS. 2 and 4. The components of the kitchen cabinet and counter top assembly 40 will therefore be referenced with the same reference numerals as were previously used in FIGS. 2 and 4. Referring now to FIG. 6, it can be seen that the vertical flange 138 of the retaining bracket assembly 134 is positioned between the drawer face plate 50 and the cabinet structure 46 in the manner described for previous embodiments. As such, the horizontal member 136 and the deflecting wall 140 are positioned below the counter top 42 and receive debris and fluid in the same manner as previously described. However, with the present invention catch container 130, the deflecting wall 140 leads into the plastic bag 132 rather than a hard wall receptacle. With debris guided into the plastic bag 132, the plastic bag 132 can then be readily removed from the retaining bracket assembly 134, without the retaining bracket assembly 134 being removed from the drawer 48 of the cabinet structure 46.

Although the above described embodiments of the present invention catch container are believed to represent the best modes of the present invention, it should be understood that many described components of the present invention have known functional equivalents. Additionally, the features shown in each described embodiment, along with the proportions, materials and orientations can be combined or otherwise modified by a person skilled in the art. More particularly, although the present invention is described with only one system that adjusts the interconnection of the receptacle to the retaining bracket, any other adjustable mechanical or adhesive interconnection means can be used and the invention so practiced. All such modifications are intended to be covered and included by the scope of the present invention as set forth in the appended claims.

What is claimed is:

1. A catch container for collecting debris material displaced over an edge of a work surface, disposed on top of a cabinet structure containing at least one drawer, wherein an overhang exists between said edge of said work surface and said cabinet structure, said catch container comprising:

a receptacle capable of retaining said debris material without leakage;

attachment means for selectively attaching said receptacle to said drawer, wherein said receptacle is held in a set position relative said cabinet structure; and a first sloped surface leading into said receptacle, said first sloped surface being disposed below said edge when said receptacle is at said set position, wherein said first sloped surface receives the debris material displaced over said edge and guides said material into said receptacle;

a second sloped surface formed at a different angle than said first sloped surface and coupled thereto, said second sloped surface being formed above said attachment means and positioned below said overhang between said edge and said cabinet structure when said receptacle is at said set position, wherein said second sloped surface receives the debris material that falls from said overhang and guides that material onto said first sloped surface.

2. The catch container according to claim 1, wherein said attachment means for attaching said receptacle to said drawer is positionably adjustable relative said receptacle, thereby allowing said receptacle to be attached in a plurality of positions relative said drawer.

3. The catch container according to claim 1, wherein said first sloped surface, said second sloped surface and said attachment means are unistructurally formed.

4. The catch container according to claim 1, wherein said second sloped surface si confined between two side walls, said side walls preventing the material received from said overhang from flowing off said second sloped surface in a direction other than toward said first sloped surface.

5. The catch container according to claim 1, wherein said receptacle includes a removable bag and a means for retaining said removable bag in an open position, wherein said first sloped surface leads into said bag.

6. The catch container according to claim 1, wherein said attachment means for attaching said receptacle to said drawer includes a generally L-shaped bracket assembly having a stem section and foot section, said L-shaped bracket assembly being attachable to said drawer by positioning said foot section in said drawer and closing said foot section in said drawer against said cabinet structure.

7. The catch container according to claim 1, wherein said second sloped surface is adjustably positionable relative said receptacle.

8. The catch container according to claim 7, wherein said second sloped surface is suspended between two arm members, said arm members having an engagement means formed thereon to selectively engage said receptacle at a desired position.

9. A container comprising:

a receptacle capable of retaining a volume of fluid;

a bracket coupled to said receptacle for removably affixing said receptacle to a top edge of a substantially vertical planar member;

a first sloped surface descending towards said receptacle; and a second sloped surface formed at a different angle than said first sloped surface and coupled thereto and, positioned outside of said receptacle above said bracket, leading to said first sloped surface from said bracket, whereby gravity directs loose material from said second sloped material onto said first sloped material and into said receptacle.

10. The container according to claim 9, wherein said bracket is positionably adjustable relative said receptacle.

11. The container according to claim 10, wherein said second sloped surface is affixed to said bracket and is positionably adjustable with said bracket relative said receptacle.

12. The container according to claim 10 further including a locking means for locking said bracket into a set position relative said receptacle.

13. The container according to claim 12, wherein said second sloped surface extends above said receptacle, said second sloped surface having side flanges at points above said receptacle thereby forming a channel structure leading into said first sloped surface.

* * * * *